United States Patent [19]

Morgan, II et al.

[11] Patent Number: 4,528,672

[45] Date of Patent: Jul. 9, 1985

[54] WELD INSERT AND REFRACTORY ANCHOR

[75] Inventors: John W. Morgan, II, Upper St. Clair; Thomas E. Klein, Library, both of Pa.

[73] Assignee: Bloom Engineering Company, Inc., Pittsburgh, Pa.

[21] Appl. No.: 580,658

[22] Filed: Feb. 16, 1984

[51] Int. Cl.[3] ..... F27D 1/04

[52] U.S. Cl. ..... 373/75; 373/76; 432/248

[58] Field of Search ..... 266/280, 286; 373/73–76, 113, 130, 165; 432/248

[56] References Cited

U.S. PATENT DOCUMENTS 3,804,585 4/1974 Twort ..... 432/248

4,401,613 8/1983 Abell et al. ..... 373/130

FOREIGN PATENT DOCUMENTS 0926482 5/1982 U.S.S.R. ..... 432/248

*Primary Examiner*—A. D. Pellinen

*Assistant Examiner*—Gregory D. Thompson

*Attorney, Agent, or Firm*—Webb, Burden, Robinson & Webb

[57] ABSTRACT

A protective refractory member for protecting heat-absorptive elements in a high-temperature furnace comprises a refractory shape, an interconnected, reticulated metal mesh embedded within the shape and positioned substantially adjacent an inner surface of the shape and at least one opening extending through a thickness of the shape and through the mesh. A tubular insert is located within the opening and is welded to the spirals which define the mesh. Both the insert and certain of the spirals engage the heat-absorptive element and the insert is welded to the element to retain the member thereto.

9 Claims, 4 Drawing Figures

WELD INSERT AND REFRACTORY ANCHOR

FIELD OF THE INVENTION

This invention relates to furnace insulation systems, and more particularly, to a protective refractory member for attachment to a heatabsorptive element in a high-temperature furnace such as a reheat furnace or electric arc furnace.

BACKGROUND OF THE INVENTION

A number of different furnace system are utilized in modern day furnaces to protect the metal structures contained therein. For example, water-cooled pipes and support structures in reheat furnaces are protected by lengths of refractory shapes positioned in end-to-end relationship and connected to the pipe or structure to be protected. Other structures in a reheat furnace are often water-cooled and must be protected. Typical examples are water-cooled box beams and water-cooled door lintels.

Some applications present expansive surface areas which must be covered with protective refractory members. One such application is the water-cooled panels which make up the wall structure and roof above the melt line in an electric arc furnace.

It is known to use a weld insert within a protective refractory member, which weld insert is welded to the underlying metal member to be protected. The present inserts are inadequately retained within the refractory member and are subjected to deterioration from concentrated heat. A need remains for a weld insert which is better anchored within the refractory and an insert which is better cooled to prevent deterioration.

SUMMARY OF THE INVENTION

Our weld insert and refractory anchor is securely retained within a refractory member, thus permitting the refractory member to be used in applications which are subjected to high and cyclic temperatures, as well as repetitive vibrations and the like. The weld insert refractory anchor is further protected from rapid deterioration through a series of contacts with the heat-absorptive element being protected. These contacts include the insert and the reinforcement which is welded to the insert.

This protective refractory member comprises a refractory shape having an interconnected, reticulated metal mesh defined by a plurality of spirals embedded within the shape and positioned substantially adjacent an inner surface of the shape. At least one opening extends through the thickness of the shape and through a spiral and a tubular insert is located within the opening adjacent the inner surface. The tubular insert is welded to the spiral which anchors the insert within the shape and the shape is subsequently welded to a heat-absorptive element by welding the insert to the element.

DESCRIPTION OF THE PREFERRED EMBODIMENTS

Figure 1:
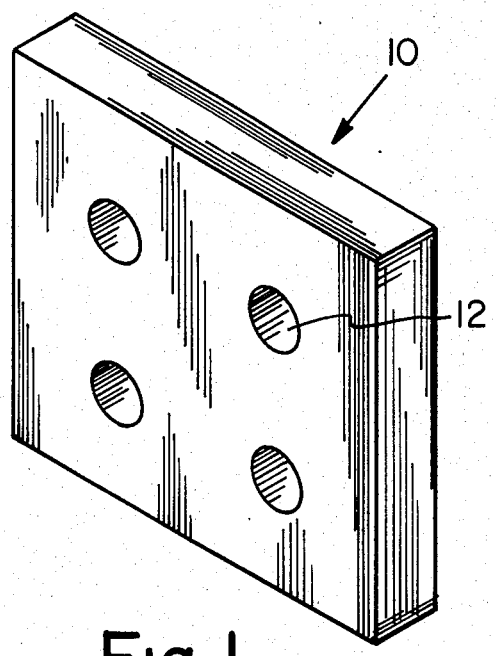
FIG. 1 is a perspective view of a flat shape with our weld insert and refractory anchors.

The protective refractory member, generally designated 10, can be of any particular shape and a flat refractory protective member for use at elevated temperatures is illustrated in FIG. 1. Four clear-through openings 12 through the shape 10 permit attachment of the shape 10 to an underlying metal substrate through conventional welding techniques.

Figure 3:
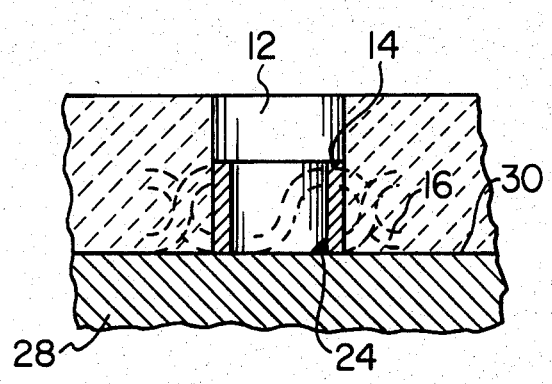
FIG. 3 is a sectional view taken along line 4—4 of FIG. 4 showing the attachment of the weld insert to a metal substrate.
Figure 2:
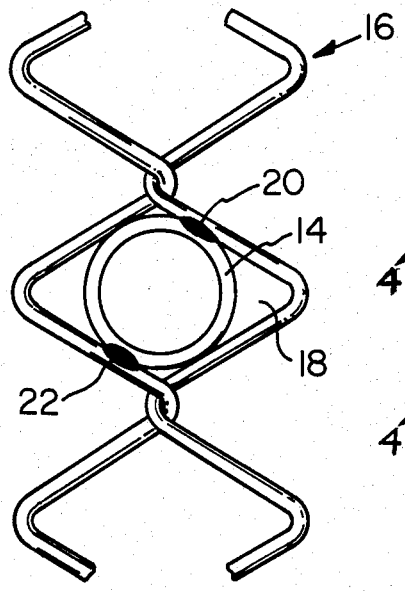
FIG. 2 is a plan view of the insert welded to the reticulated metal mesh.

The weld insert and refractory anchor are best seen in FIGS. 2 and 3. A reticulated metal mesh 16 is embedded within the shape 10 and is positioned along the inner surface 30 which abuts the heat-absorptive element 28 to be protected. Mesh 16 is formed of a pair of bent wires interconnected to define a plurality of spirals 18, FIG. 2. The weld insert 14, which is a tubular member, is positioned within a spiral 18 at the inner surface 30 and is spot-welded (20 and 22) at diametrically opposed positions to the two different wires which make up the spiral in the first instance. Both the insert 14 and at least some of the mesh are exposed along the inner surface 30 of the shape 10 so as to be in direct engagement with the metal substrate 28. Weld insert 14 is of lesser axial extent than the shape 10 so that the opening 12 in a typical castable refractory is actually defined by two different cross sections, with the smaller cross section being the inside diameter of the insert. In other refractories such as phosbonded products the opening 12 is the same as the inside diameter of the insert.

The shape 10 is positioned against the heat-absorptive metal element 28 and a weld rod is inserted into the opening 12 and into the tubular insert 14 and the tubular insert 14 is welded to the metal substrate to hold the shape thereto. This weld may go around the inside perimeter of the insert 14 or, as shown, may be a fillet weld 24 or a pair of such welds.

The size of the opening 12 through the refractory and the inside diameter of the insert 12 are sufficiently large to allow the necessary angle for the weld rod so that a good structural weld is obtained.

The combination of the reticulated metal mesh in the form of spirals welded to the insert provides a strong anchor system. The fact that both the insert and at least certain of the spirals which are welded to the insert engage the cool, metal surface to be protected prevents the rapid deterioration of the insert and provides a better over-all insulation of the heat-absorptive member.

Figure 4:
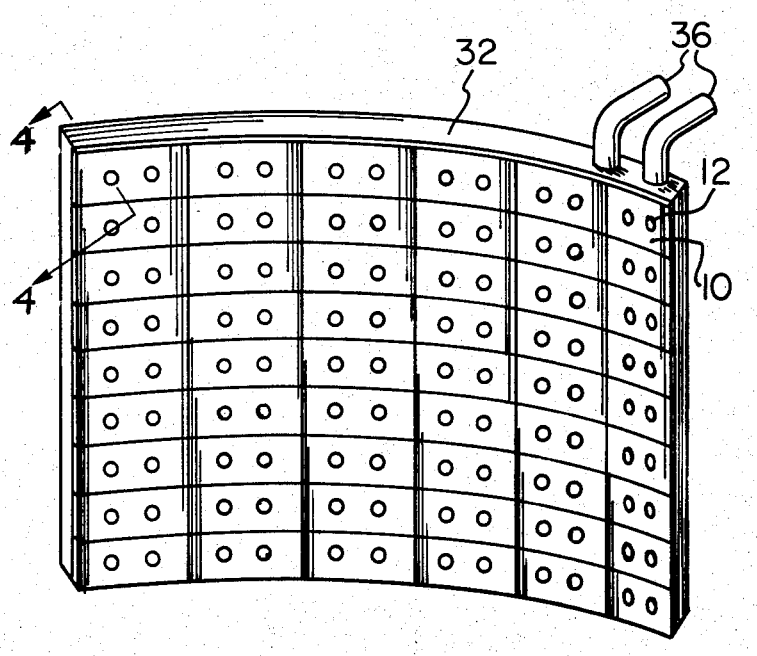
FIG. 4 is a perspective view of a water-cooled side wall panel used in an electric arc furnace.

A typical application is illustrated in FIG. 4 in which a water-cooled metal panel 32 having inlet and outlet pipes 36 is protected by a plurality of refractory shapes 10. Such a water-cooled panel is used as side walls in electric arc furnaces above the slag line. Shape 10 is welded to the water-cooled metal panel 32 through the two openings 12. After welding has taken place, a refractory filler is used to close in each opening 12. The particular panel illustrated in FIG. 4 has a slight curvature to it, although a plurality of small flat shapes can be used to protect the ever-so-slight curvature. Of course, it will be recognized that the shape itself could be curved in the same manner as the underlying substrate and the weld insert and refractory anchor would be employed in the same manner.

A typical shape will be made of an alumina refractory which can withstand the particular elevated temperature of the intended application. The spirals will be formed of 314 stainless steel having a 0.120 inch diameter (standard 11 gauge). The spirals are formed by two interconnected wires having $5\frac{1}{2}$ turns for every 11 inches of length. The spirals form an opening to accommodate a $1\frac{1}{2}$ inch diameter insert. The insert, which is made out of a standard stainless steel pipe, such as 304 stainless, is $\frac{3}{4}$ inch high. Both the wire and insert may be made of other weldable metals such as carbon steel or corten. The height of the insert varies depending on the density of the refractory, with a longer insert being feasible in a less dense, better insulated shape. Generally, the insert will be on the order of $\frac{1}{2}$ the thickness of the shape but $\frac{3}{4}$ inch inserts have also been used with 2 inch thick shapes.

The number of inserts per shape depends primarily on the size of the refractory member, although applications in which the refractory is subjected to severe vibration, may also require more inserts. Presently, flat refractory members 9"×9" and 6"×9" require two inserts per shape. Shapes of a foot square or more may require more inserts although four inserts per shape is more than adequate for the larger shapes. Two or more spaced inserts can also be utilized along a single length of spirals to reduce handling in manufacture and provide continuity.

It is also possible to use a single wire bend formed into half spirals in conjunction with a weld insert. Such an arrangement finds particular application with smaller shapes.

We claim:

1. A protective refractory member for protecting a heat-absorptive element in a high-temperature furnace comprising a refractory shape, an interconnected reticulated metal mesh embedded within the shape positioned substantially adjacent an inner surface of the shape, at least one opening extending through a thickness of said shape and through said mesh to form a clear-through, uninterrupted passageway, a tubular insert located within the passageway and extending to said inner surface, said insert being welded to said reticulated metal mesh, said member adapted for attachment to an element by engaging said inner surface to an element and welding said insert thereto.

2. The member of claim 1, said member being substantially flat.

3. The member of claim 2, said mesh being defined by a plurality of spirals, said insert fitting within a spiral and welded thereto.

4. The member of claim 2, said insert having an axial extent less than a thickness of said member.

5. In combination, a heat-absorptive element in a high-temperature furnace and a plurality of protective refractory members positioned in side-by-side relationship to substantially cover said element, each member including an interconnected, reticulated metal mesh in the form of a plurality of spirals embedded within the member and positioned substantially adjacent an element contacting surface of said member so that at least certain of said spirals engage said element, at least two spaced-apart openings, each extending axially through a thickness of said member and through a spiral, a tubular insert located in each opening at said contacting surface in engagement with said element, said insert being welded to said spiral and to said element to retain said member thereto.

6. The combination of claim 5, said members being substantially flat.

7. The member of claim 5, said insert having an axial extent less than a thickness of said member.

8. The member of claim 5, said insert and said mesh being selected from the group of stainless steel, carbon steel, and corten.

9. The member of claim 5, said spirals formed by a pair of interconnected, bent-formed wires having on the order of $5\frac{1}{2}$ turns for every 11 inches of length.

* * * * *